US011009314B2

(12) United States Patent
Courtice

(10) Patent No.: US 11,009,314 B2
(45) Date of Patent: May 18, 2021

(54) ADJUSTMENT ASSEMBLY IN A FIREARM SIGHT

(71) Applicant: Shield Sights Ltd, Bournemouth (GB)

(72) Inventor: Mathew Courtice, Bournemouth (GB)

(73) Assignee: Shield Sights Ltd, Bournemouth (GB)

( * ) Notice: Subject to any disclaimer, the term of this patent is extended or adjusted under 35 U.S.C. 154(b) by 0 days.

(21) Appl. No.: 16/378,690

(22) Filed: Apr. 9, 2019

(65) Prior Publication Data

US 2019/0353454 A1 Nov. 21, 2019

(30) Foreign Application Priority Data

May 18, 2018 (GB) ..... 1808152

(51) Int. Cl.

| | |
|---|---|
| ***F41G 1/30*** | (2006.01) |
| ***F41G 1/26*** | (2006.01) |
| ***F41G 1/06*** | (2006.01) |
| ***F41G 1/01*** | (2006.01) |

(52) U.S. Cl.

CPC ..... *F41G 1/30* (2013.01); *F41G 1/01* (2013.01); *F41G 1/065* (2013.01); *F41G 1/26* (2013.01)

(58) Field of Classification Search

CPC ..... F41G 1/26; F41G 1/20; F41G 1/28; F41G 1/30; F41G 3/2644; F41G 3/2612

See application file for complete search history.

(56) References Cited

U.S. PATENT DOCUMENTS 10,175,029 B2 * 1/2019 Teetzel ..... F41G 1/06
2015/0198415 A1 7/2015 Campean
2015/0267997 A1 * 9/2015 Collin ..... G02B 5/32 359/1
2016/0305741 A1 * 10/2016 Jeung ..... F41G 1/30
2020/0240748 A1 * 7/2020 Connolly ..... F41G 1/30

FOREIGN PATENT DOCUMENTS

CA 2736912 A1 * 3/2010 ..... F41G 11/003
CN 107726255 A 2/2018

OTHER PUBLICATIONS

"Shield Sights RMS in Full Production." Recoil Magazine. Oct. 20, 2016. pp. 1-5. Retrieved from https://www.recoilweb.com/shield-sights-rms-in-full-production-114290.html on May 20, 2019.

* cited by examiner

*Primary Examiner* — Sephen Johnson

(74) *Attorney, Agent, or Firm* — Patterson + Sheridan LLP

(57) ABSTRACT

A reflector sight for a firearm, comprises an adjustment assembly for adjusting the location of a reticule within the field of view. The adjustment assembly comprises: a pair of vertical and horizontal adjustment screws; and a carrier body associated with a reticule generator, the carrier body having a pair of mutually perpendicular channels within which respective substantially cylindrical barrel nuts for the pair of adjustment screws are located. Each channel is configured to allow longitudinal movement of its respective barrel nut along the channel but relative movement perpendicular thereto is constrained, such that rotation of the adjustment screws can move the carrier in the horizontal and vertical directions without requiring any axial movement of the adjustment screws.

17 Claims, 17 Drawing Sheets

ADJUSTMENT ASSEMBLY IN A FIREARM SIGHT

CROSS-REFERENCE TO RELATED APPLICATIONS

This Application claims priority to United Kingdom (GB) Patent Application No. 1808152.1, filed on May 18, 2018, which is incorporated by reference herein in its entirety.

INTRODUCTION

The present invention concerns sights for firearms, and adjustment assemblies therein. More particularly, but not exclusively, this invention concerns a reflector sight comprising an adjustment assembly. The invention also concerns a firearm comprising a reflector sight and a method of adjusting a reflector sight.

Reflector sights for firearms are well-known. A reflector sight typically provides an image of a reticule (for example a red-dot reticule) within a field of view. Performance of reflector sights can sometimes be limited by foreign bodies interfering with the reticule generator (typically an LED light source) that is used to display the reticule image. For example, if water, dust or other debris reaches the LED light source it may interfere with the light emission and/or the associated electronics. It is therefore desirable to protect the reticule generator as much as possible.

In principle, the reticule of a reflector sight, can be used instead of having iron sights on the firearm. However, many users prefer the reticule in combination with the iron sights (for example so that they can readily switch to the iron sights in the unlikely event of the reflector sight being rendered inoperable). To enable a consistent firing position, and to enable the user to readily switch between use of the iron sights and the reflector sight, it is desirable to ensure co-witness of the iron sights and the reticule of the reflector sights. It is therefore desirable to provide a sight that can be mounted relatively low on the firearm. This is especially the case for a small firearm such as a handgun.

In order to calibrate a reflector sight it tends to be necessary to provide an adjustment assembly to adjust the location of the reticule in the field of view (for example to center the reticule and/or ensure co-witness with the iron sights where necessary).

Providing an adjustment assembly that can be used on a low-mounted sight, and also providing an adjustment assembly that maintains sufficient protection of the reticule generator from foreign bodies has proved challenging.

Embodiments of the present invention seek to mitigate at least some of the above-mentioned problems. Alternatively or additionally, embodiments of the present invention seek to provide an improved reflector sight for a firearm, especially one that can be used with the reticule in co-witness with the iron sights.

BRIEF SUMMARY

According to a first aspect of the invention, there is provided a reflector sight for a firearm, the sight being configured to display a reticule within a field of view. The reflector sight comprises an adjustment assembly for adjusting the location of the reticule within the field of view, the adjustment assembly comprising: a first adjustment screw for adjusting the location of the reticule in a horizontal direction; and a second adjustment screw for adjusting the location of the reticule in a vertical direction. The adjustment assembly comprises: a carrier body associated with a reticule generator such that movement of the carrier results in corresponding movement of the reticule in the field of view, the carrier body having a first channel receiving a first barrel nut, and a second channel receiving a second barrel nut, the first barrel nut being in screw-threaded engagement with the first adjustment screw; and the second barrel nut being in screw-threaded engagement with the second adjustment screw. Wherein the first channel is orientated vertically to allow relative movement between the carrier body and the first barrel nut along the channel in the vertical direction (but relative movement in the horizontal direction is substantially prevented), and the second channel is orientated horizontally to allow relative movement between the carrier body and the second barrel nut along the channel in the horizontal direction (but relative movement in the vertical direction is substantially prevented), such that rotation of the first adjustment screw can move the carrier in the horizontal direction without horizontal movement of the first adjustment screw, and rotation of the second adjustment screw can move the carrier in the vertical direction without vertical movement of the second adjustment screw.

Such an arrangement has been found to be especially beneficial. In particular, since the adjustment screws engage respective barrel nuts that can move along their associated channels in mutually perpendicular directions, but are otherwise constrained within the carrier, the adjustment screws can be used to adjust the position of the carrier without any axial movement of those screws. This enables a simple, but effective, seal around the adjustment screw because it does not need to cater for axial movement. For example, an O-ring circumferentially-extending around each adjustment screw may suffice.

The adjustment assembly is for adjusting the location of the reticule within the field of view. In many firearms, it is not necessary to make repeated adjustments once the reticule is correctly located. Accordingly the adjustment assembly may also be considered as a calibration assembly and the terms may be used synonymously.

The first and second adjustment screws may each comprise a respective longitudinal axis along their length. The first channel may be parallel to the longitudinal axis of the second adjustment screw. The second channel may be parallel to the longitudinal axis of the first adjustment screw. Such an arrangement may ensure there can be relative movement, in the direction along the axis of an adjustment screw, between the carrier and the barrel nut associated with the other adjustment screw. This, in turn, may ensure that rotation of an adjustment screw moves the carrier in an axial direction along that screw, rather than moving the screw in that axial direction.

The longitudinal axis of the first adjustment screw is preferably coaxial with the second channel. The adjustment screws may be positioned such that the longitudinal axes of the first and second adjustment screws intersect. The above-mentioned features tend to facilitate a compact arrangement because the adjustment screws are not offset from one another. Moreover, because embodiments of the invention do not require axial movement of the adjustment screws, the adjustment screws may have their longitudinal axes intersecting, without risk of the screws fouling on each other, or otherwise interfering, when adjusted. Thus, embodiments of the invention may enable the reflector sight to be mounted relatively low on the firearm. Being able to mount the reflector sight relatively low on the firearm may allow co-witness of the reticule with iron sights (in the event that the fireman has an iron sight; it will be appreciated that the reflector sight may be used irrespective of the presence of the iron-sight as the reticule alone may provide a suitable aiming function). This may be especially advantageous for a small firearm such as a handgun.

The reflector sight may be a reflex reflector sight.

The reticule generator may comprises a light source for creating an image. The image is preferably a reticule image. The reticule generator may comprises an LED unit. The LED unit may be configured to create a dot reticule. It will be appreciated that the reticule may also be referred to as an "aiming mark" or alike.

The sight is configured to display the reticule within the field of view. The reticule may be displayed on a lens (i.e. the reticule is reflected back into the user's eye such that it appears on the lens). The sight may have a window within which the lens is located. The field of view may be the view of the user within the window and/or lens, when the user is aiming the firearm (for example looking along the sight).

The carrier body is associated with a reticule generator such that movement of the carrier results in corresponding movement of the reticule in the field of view. In principle the carrier body may indirectly act on the reticule generator (for example movement of the reticule generator via an intermediate component, or for example movement of a component such as a lens that adjusts the location of the output of the reticule generator). More preferably, the reticule generator is mounted on the carrier body. Such an arrangement may provide a simple but reliable way of adjusting the reticule position. The reticule generator may be held on the carrier via a pair of retaining arms.

The first and/or second barrel nuts may be substantially cylindrical in shape. The cylinder may have a non-circular cross section, but more preferably the cylinders are right-circular cylinders. The shape of the barrels nuts preferably complements the shape of the respective channels in which they are located, such that longitudinal movement along the channel is possible, but non-longitudinal movement is restricted, and more preferably non-longitudinal movement is substantially prevented. For example there is preferably a small tolerance between the barrel nut and the channel. The first and/or second barrel nut may comprise a screw threaded hole extending normal to the longitudinal axis of the barrel nut (for example normal to the longitudinal axis of the cylinder).

The first channel in the carrier may comprise a vertical through-bore to enable vertical movement of the carrier relative to the first barrel nut, when the vertical adjustment screw is rotated. The second channel in the carrier may comprise a horizontal bore to enable horizontal movement of the carrier relative to the second barrel nut, when the horizontal adjustment screw is rotated. The bore may be a blind bore.

The reflector sight may comprise a housing within which the adjustment unit is mounted. The heads of the first and second adjustment screws may be accessible from the exterior of the housing. The sight may comprise a circumferential seal located between the housing and each of the adjustment screws. The seal may comprise an O-ring around the shank of the adjustment screw.

The barrel nuts and the carrier body may be located within a cavity. The cavity may be formed in the underside of the housing. The cavity may be sealed at its base by a base element.

The first barrel nut may comprise a locating peg. The locating peg may be received in a corresponding locating recess (for example in a corresponding locating recess in the housing). The locating peg may be received in the corresponding locating recess such that movement in only the horizontal direction is possible. The locating peg is preferably configured to prevent movement in other directions. Specifically, the locating peg may be configured to prevent twisting of the adjustment assembly about a horizontal axis. A risk of twisting (rotation) about a horizontal axis has been found to occur when the longitudinal axis of the first adjustment screw and the longitudinal axis of the second barrel nut become closely aligned.

The first barrel nut is preferably unable to move in a vertical direction (for example relative to the horizontal adjustment screw, and/or relative to the cavity). The first barrel nut may be able to move in a horizontal direction (relative to the horizontal adjustment screw, and/or relative to the cavity). The screw threaded engagement between the horizontal adjustment screw and the first barrel nut may prevent said vertical movement (the adjustment screw also being located within the housing). The screw threaded engagement is preferably of a tight tolerance to substantially prevent such movement.

The second barrel nut is preferably unable to move in a horizontal direction (relative to the vertical adjustment screw, and/or relative to the cavity). The second barrel nut may be able to move in a vertical direction (relative to the vertical adjustment screw, and/or relative to the cavity). The screw threaded engagement between the vertical adjustment screw and the second barrel nut may prevent said horizontal movement (the adjustment screw also being located within the housing). The screw threaded engagement is preferably of a tight tolerance to substantially prevent such movement.

Such an arrangement described in the directly preceding paragraphs is beneficial because it may allow the movement, within the cavity, of the carrier relative to one of the barrel nuts, whilst the other barrel nut remains stationary relative to the carrier.

It may be that the carrier is only moveable under the action of the respective adjustment screws. For example, it may be that the position of the carrier is only dictated by the relative rotation of the adjustment screws in the corresponding barrel nuts. The adjustment mechanism preferably does not require, and preferably does not comprise, a biasing mechanism for biasing the carrier in a particular direction (for example in one or more directions within a housing).

In some embodiments, the screw-threaded engagement between each adjustment screw and the respective barrel nut may be of a sufficiently tight tolerance to substantially prevent play, or other unintentional movement, between said components. It has been found that having such a tight tolerance can, however, lead to difficulties. For example, during assembly of the adjustment mechanism the adjustment screw may become cross-threaded, and/or it may be challenging to manufacture threads with the necessary high tolerance at a reasonable cost. To address this, in some embodiments of the invention, the screw-threaded engagement between each adjustment screw and its respective barrel nut may be of a lower tolerance and the adjustment mechanism may comprise a biasing member arranged to bias the screw thread of the adjustment screw onto the screw thread of the barrel nut. Any undue play in the screw-threaded engagement that would otherwise arise from the lower tolerance, may thereby be mitigated by the action of the biasing member.

The biasing member may be a grub screw. The grub screw may be arranged to exert a biasing force in a direction perpendicular to the longitudinal axis of the adjustment screw. The biasing force may therefore act in a substantially radial direction (relative to the screw-threaded engagement of the adjustment screw/barrel nut) to urge the respective threads of the screw and barrel nut together. The biasing member may located in a bore in the barrel nut. This bore may intersect the screw-threaded bore in the barrel nut into which the adjustment screw is located. The bores may be mutually perpendicular.

The end of the biasing member may comprise a resiliently deformable material for exerting the biasing force on the adjustment screw without damaging the screw thread. For example the biasing member may comprise a nylon end. The biasing member may be formed of this resiliently deformable material, but more preferably the biasing member comprises a resiliently deformable end for exerting the biasing force and a less deformable material (for example a metallic material such as steel) at the opposing end for receiving a tool (such as a screw driver blade or Allen key). In some embodiments, the distal end of each biasing member may comprise a separate piece of resilient material which is itself biased onto the thread of the adjustment screw by the other part of the biasing member (for example a grub screw pressing a piece of nylon onto the thread of the adjustment screw).

According to a second aspect of the invention, there is provided a firearm comprising the sight according to any aspect described herein. The firearm is preferably a small arms firearm. The firearm may be a handgun. The firearm may be a pistol.

According to another aspect of the invention, there is provided a method of adjusting a reticule within a field of view on a firearm reflector sight, the method comprising the steps of: adjusting the location of the reticule in a horizontal direction by rotating a first adjustment screw to screw the adjustment screw relative to a first barrel nut; and adjusting the location of the reticule in a vertical direction by rotating a second adjustment screw to screw the adjustment screw relative to a second barrel nut. The barrel nuts are located within mutually perpendicular channels in a carrier body associated with a reticule generator such that the rotation of the first adjustment screw moves the carrier in the horizontal direction without horizontal movement of the first adjustment screw, and the rotation of the second adjustment screw moves the carrier in the vertical direction without vertical movement of the second adjustment screw.

According to yet another aspect of the invention, there is provided a reflector sight for a firearm, the sight being configured to display a reticule within a field of view, wherein the reflector sight comprises an adjustment assembly for adjusting the location of the reticule within the field of view, the adjustment assembly comprising: a pair of mutually perpendicular adjustment screws for adjusting the location of the reticule in respective perpendicular directions; and a carrier body associated with a reticule generator, the carrier body having a pair of mutually perpendicular channels within which respective barrel nuts for the pair of adjustment screws are located. Each channel is configured to allow longitudinal movement of its respective barrel nut along the channel but relative movement perpendicular thereto is constrained, such that rotation of the adjustment screws can move the carrier in the mutually perpendicular directions without requiring any axial movement of the adjustment screws.

According to yet another aspect of the invention, there is provided an adjustment assembly for use as the adjustment assembly in the reflector sight according to any aspect described herein.

It will of course be appreciated that features described in relation to one aspect of the present invention may be incorporated into other aspects of the present invention. For example, the method of the invention may incorporate any of the features described with reference to the apparatus of the invention and vice versa.

BRIEF DESCRIPTION OF THE DRAWINGS

Embodiments of the present invention will now be described by way of example only with reference to the accompanying schematic drawings of which.

DETAILED DESCRIPTION

Figure 1:
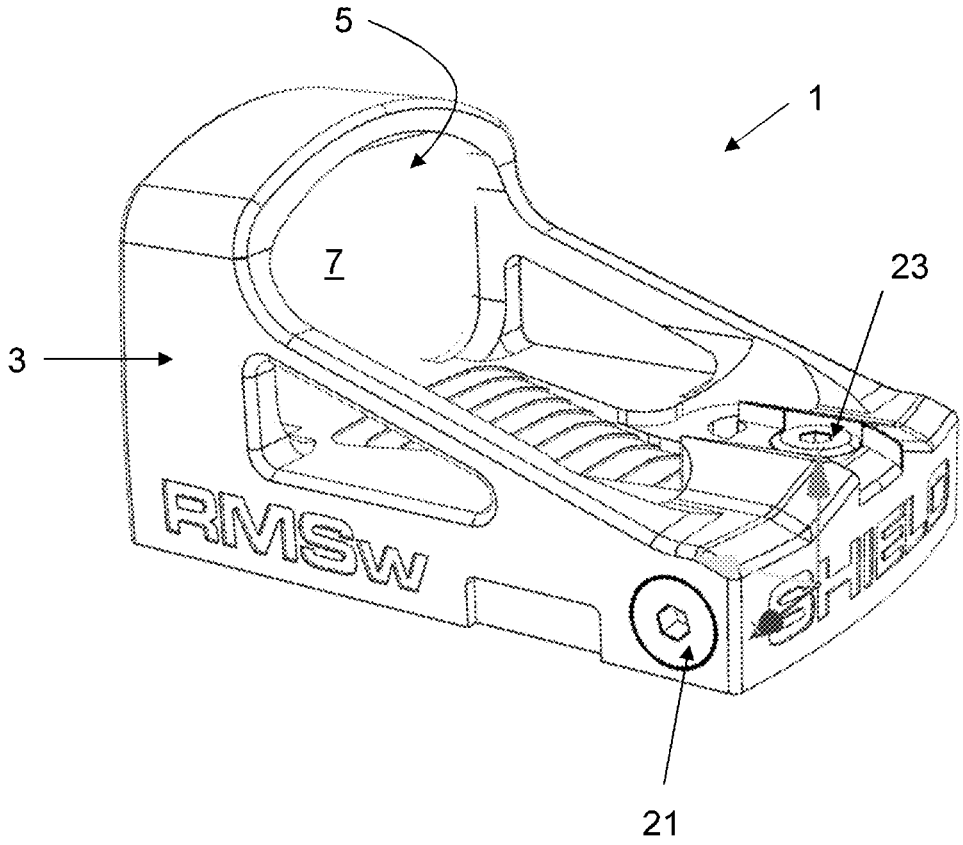
FIG. 1 shows a perspective view a reflector sight according to a first embodiment of the invention.
Figure 2A:
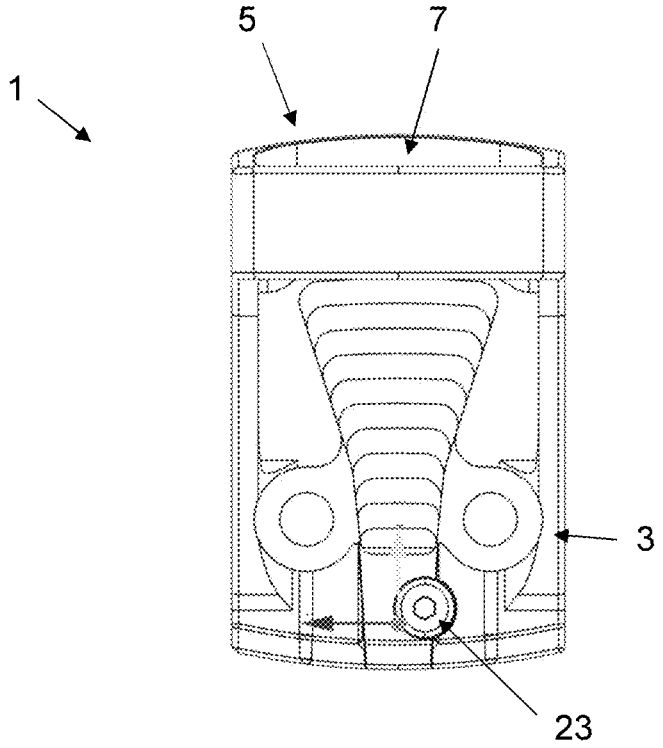
FIGS. 2*a-d* show orthographic projections of the sight in FIG. 1.
Figure 2B:
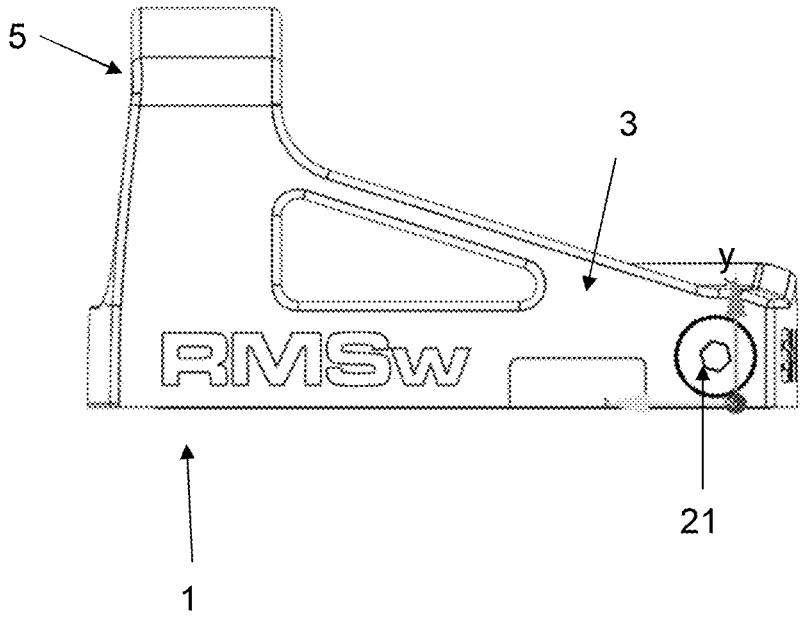
Figure 2C:
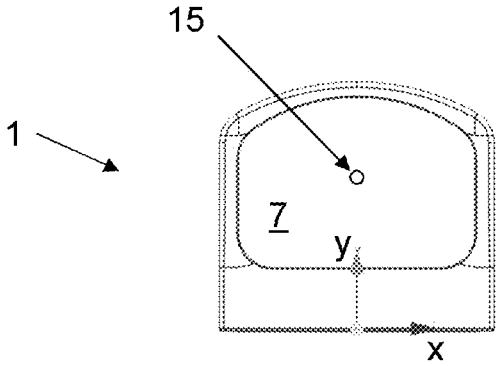
Figure 2D:
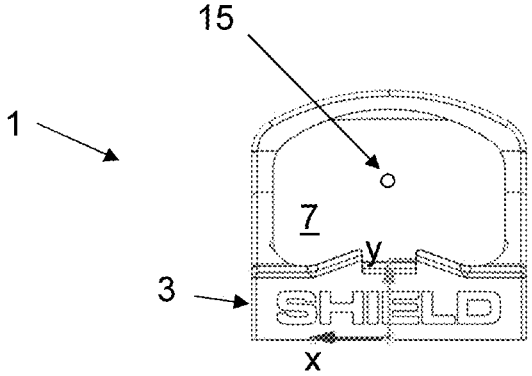

FIGS. 1 to 2*d* show a reflector sight 1 for a firearm according to a first embodiment of the invention. The reflector sight comprises a housing 3, which defines a window frame 5 at one end and into which a lens 7 is fixed. At the other end, the sight 1 contains an LED module 9 (not visible in FIGS. 1-2*d*, but shown in exploded views in FIGS. 3*b* and 3*c*). The LED module 9 comprises an LED and associated electronics and projects a beam of red light onto the lens 7. This reflects a red dot reticule 15, visible in the user's field of view when looking along the sight 1, towards the window frames and through the lens 7. The LED module 9 is powered by a battery 11 accommodated in the base 13 of the housing 3 (see exploded view in FIG. 3*b*).

In general terms, the above-mentioned features are generally known in reflector sights per se and will be readily understood by the skilled person. For example, such features may be found in general terms on the Reflex Mini Sight (RMS) by SHIELD SIGHTS LTD.

Figure 9:
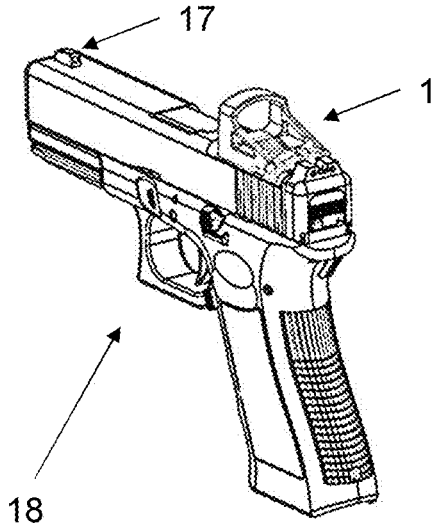
FIG. 9 shows the reflector sight of the first embodiment installed on a pistol.

It is beneficial to be able to mount the sight 1 on a firearm relatively low down, such that the reticule 15 can be relatively close to the barrel height and/or have co-witness with iron-sights 17 on the firearm 18 (where the iron sights are present). FIG. 9 shows the sight of the first embodiment mounted on a pistol 18.

The LED module 9 may have to be adjusted to center, or correctly locate, the reticule 15 on the lens. Embodiments of the present invention primarily relate to aspects of an adjustment assembly 19, located at the rear of the sight 1, which enables adjustment of the reticule 15 within the field of view. Features of that adjustment assembly 9 will now be described with reference to the Figures, and especially FIGS. 3*b* to 8.

The adjustment assembly 19 comprises a horizontal adjustment screw 21 for adjusting the location of the reticule in the field of view in a horizontal direction X; and a vertical adjustment screw 23 for adjusting the location of the reticule in a vertical direction Y. The horizontal and vertical adjustments are effected by rotation of the adjustment screws 21, 23, as will be apparent from the description below. It will be appreciated that reference herein to 'horizontal' and 'vertical' are relative to the frame of reference of the sight 1 (see axes in the Figures) rather than an absolute reference frame.

Figure 3A:
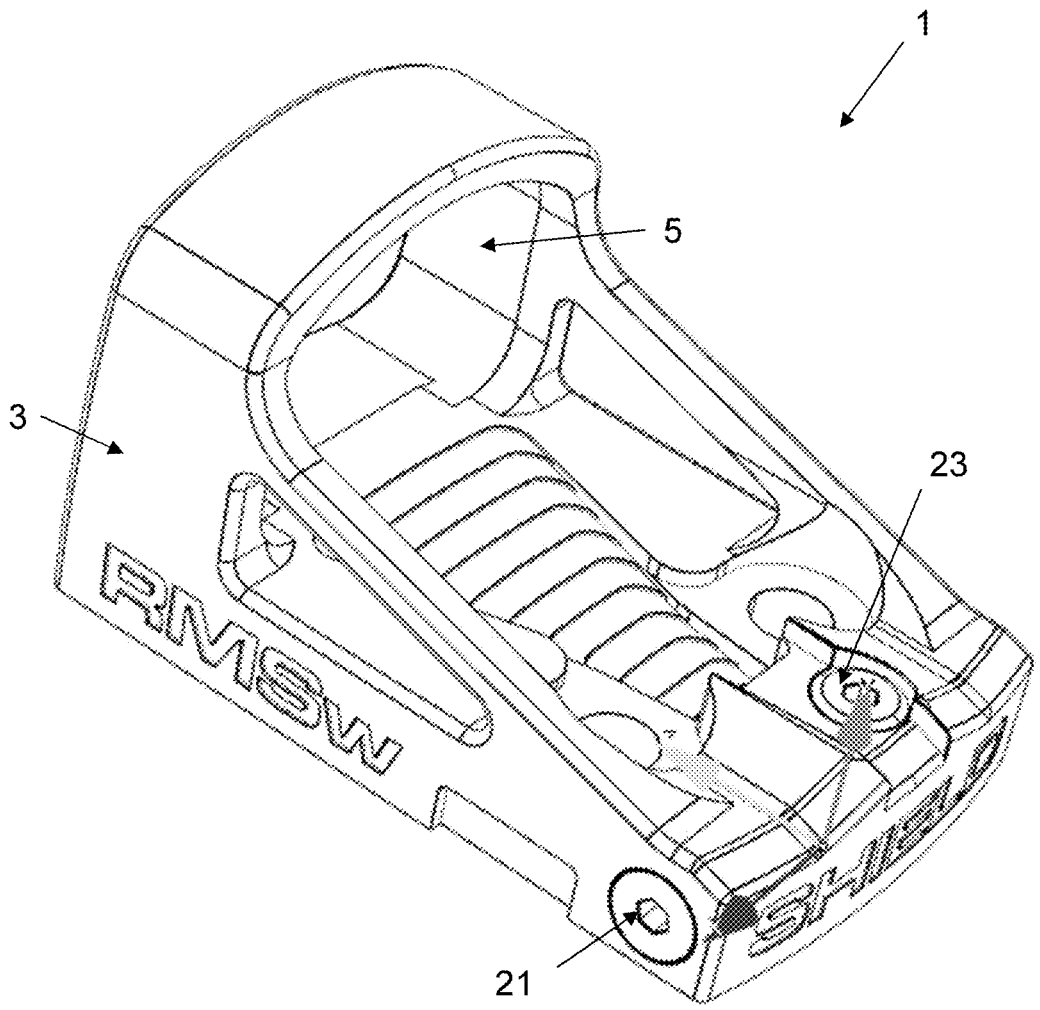
FIGS. 3*a-c* show perspective views of the sight in the first embodiment in an unexploded view, and two partially exploded views.
Figure 3B:
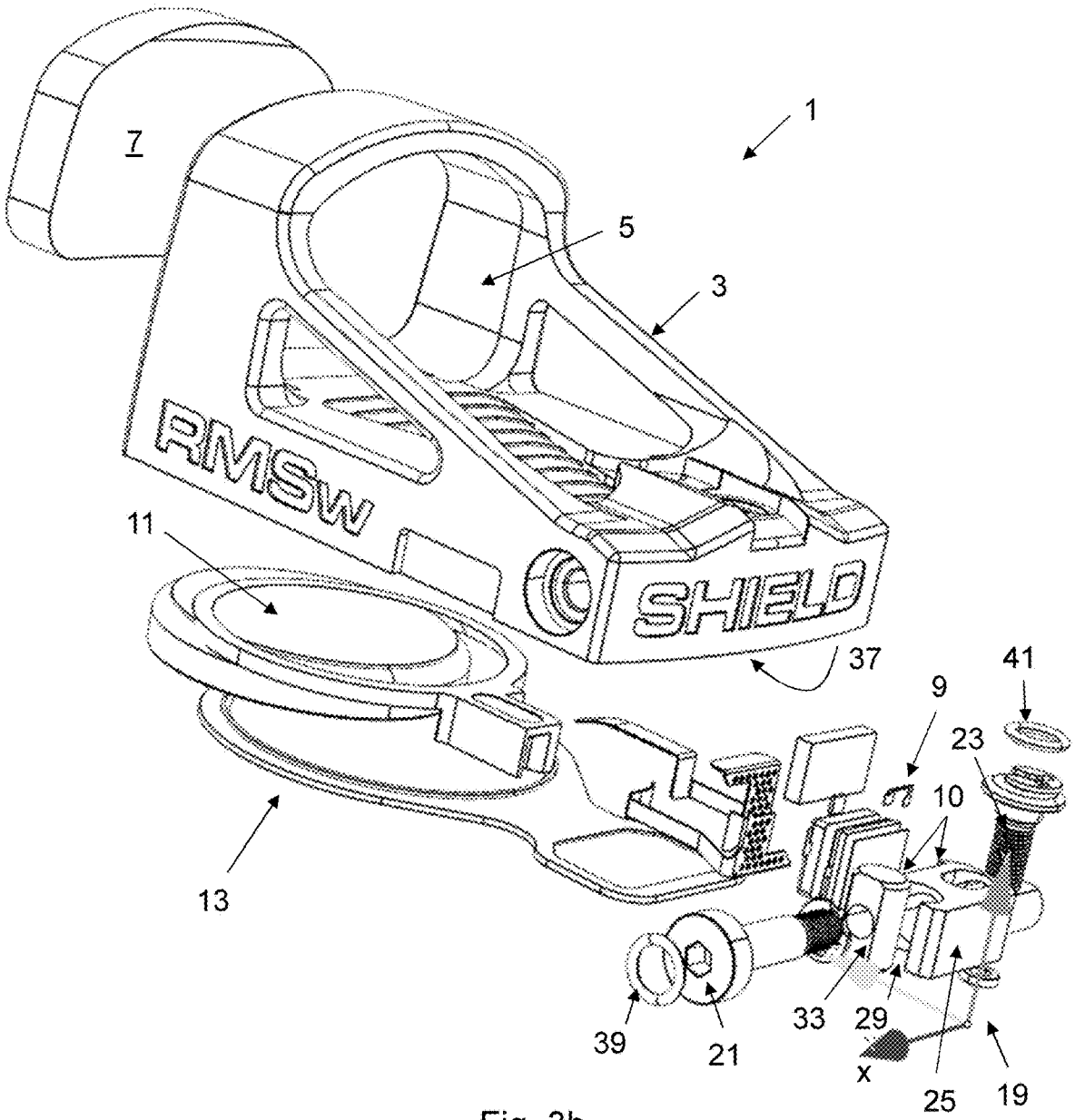
Figure 3C:
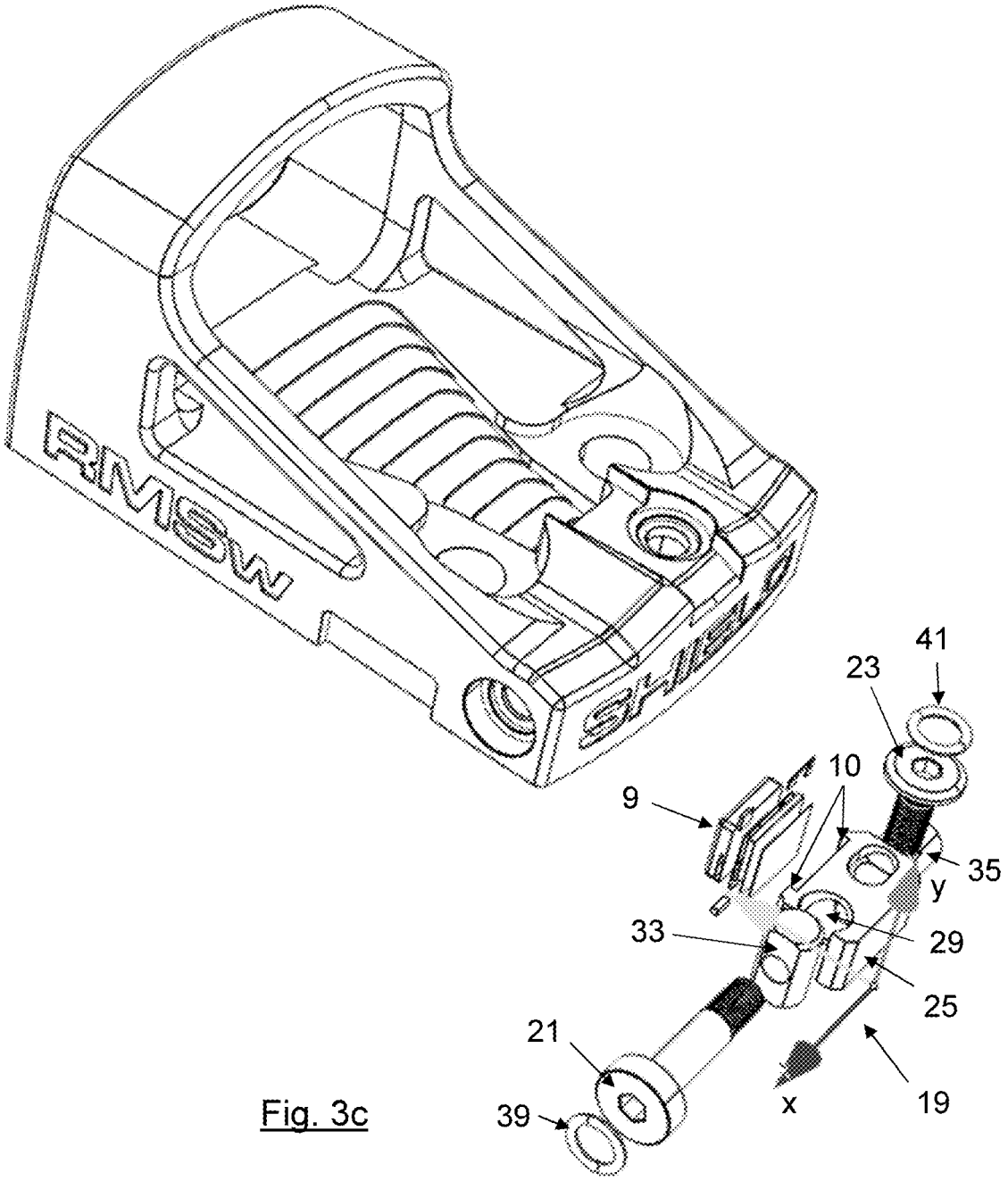
Figure 8:
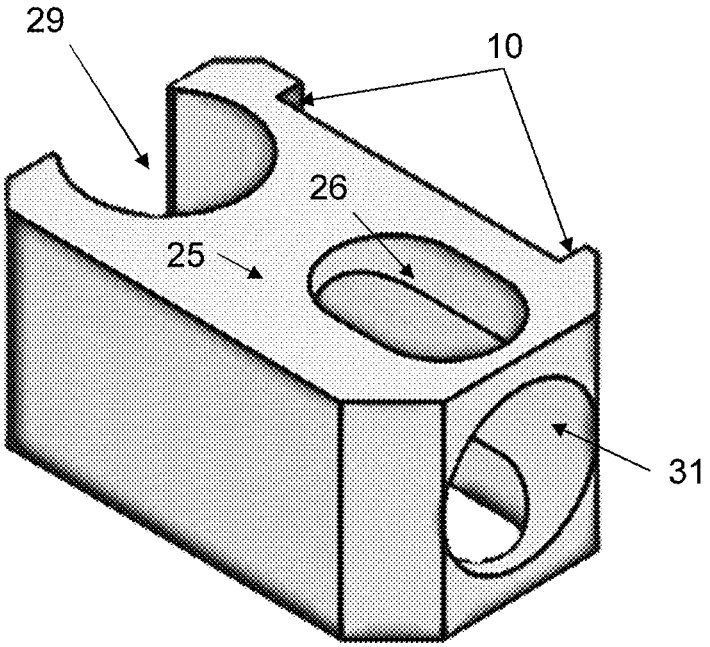
FIG. 8 shows the carrier of the adjustment assembly in isolation.

Referring to FIGS. 3*b* and 8, the adjustment assembly 19 comprises a carrier body 25 onto which the LED module 9 is mounted. The LED module 9 is fixedly mounted, between a pair of retaining arms 10, such that movement of the carrier body 25 results in corresponding movement of the reticule 15 in the field of view (i.e. where projected onto the lens 7). The carrier body 25 has a first channel 29 running vertically through the height of the carrier body 25 and a second channel 31 formed as a bore running horizontally into the carrier body 25 from one end.

The first (i.e. vertical) channel 29 contains a barrel nut 33 that is a complementary shape with the channel 29 such that it allows the carrier body 25 to move along (i.e. up and down) the vertical barrel nut 33. The second (i.e. horizontal) channel 31 also contains a barrel nut 35 that is a complementary shape with the channel such that it allows the carrier body to move along (i.e. laterally) the horizontal barrel nut 35. This movement is described in more detail below.

The first barrel nut 33 (located in the vertical channel 29) is in screw-threaded engagement with the horizontal adjustment screw 21. The screw thread is perpendicular to the axis 33' of the barrel nut (see FIG. 7). To prevent the horizontal adjustment screw 21 fouling on the carrier body 25 during relative movement between the carrier body 25 and the barrel nut 33, the vertical channel 29 is open sided.

The second barrel nut 35 (located in the horizontal channel 31) is in screw-threaded engagement with the vertical adjustment screw 23. The screw thread is perpendicular to the axis 35' of the barrel nut 35. To prevent the vertical adjustment screw 23 fouling on the carrier body 25 during relative movement between the carrier body 25 and the barrel nut 35, the top face of the carrier body 25 comprises a stretched bore 26 into which the vertical screw 23 extends.

Figure 4A:
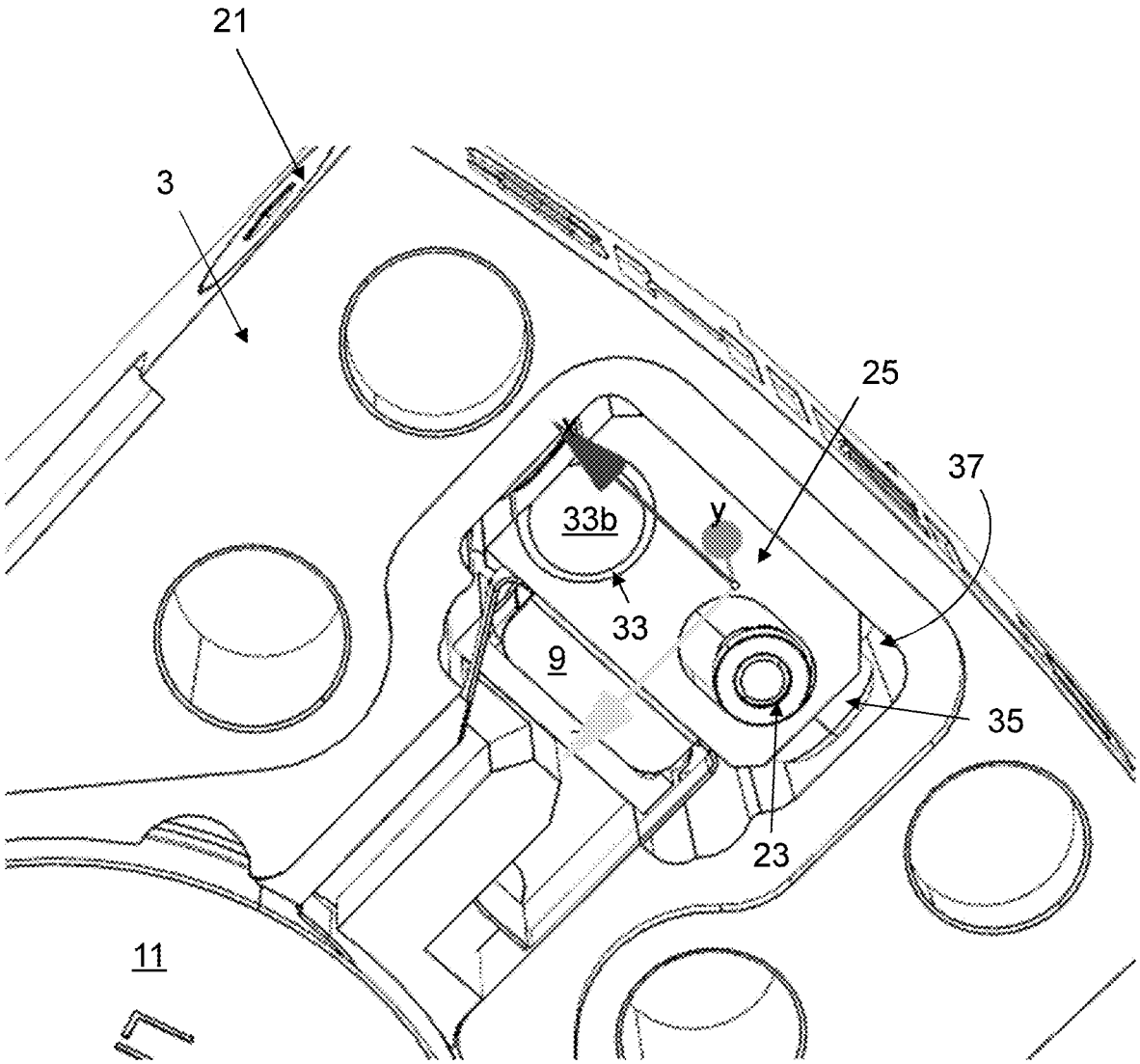
FIG. 4*a* is a view of part of the underside of the sight, with the base removed and showing the adjustment assembly within the housing.
Figure 4B:
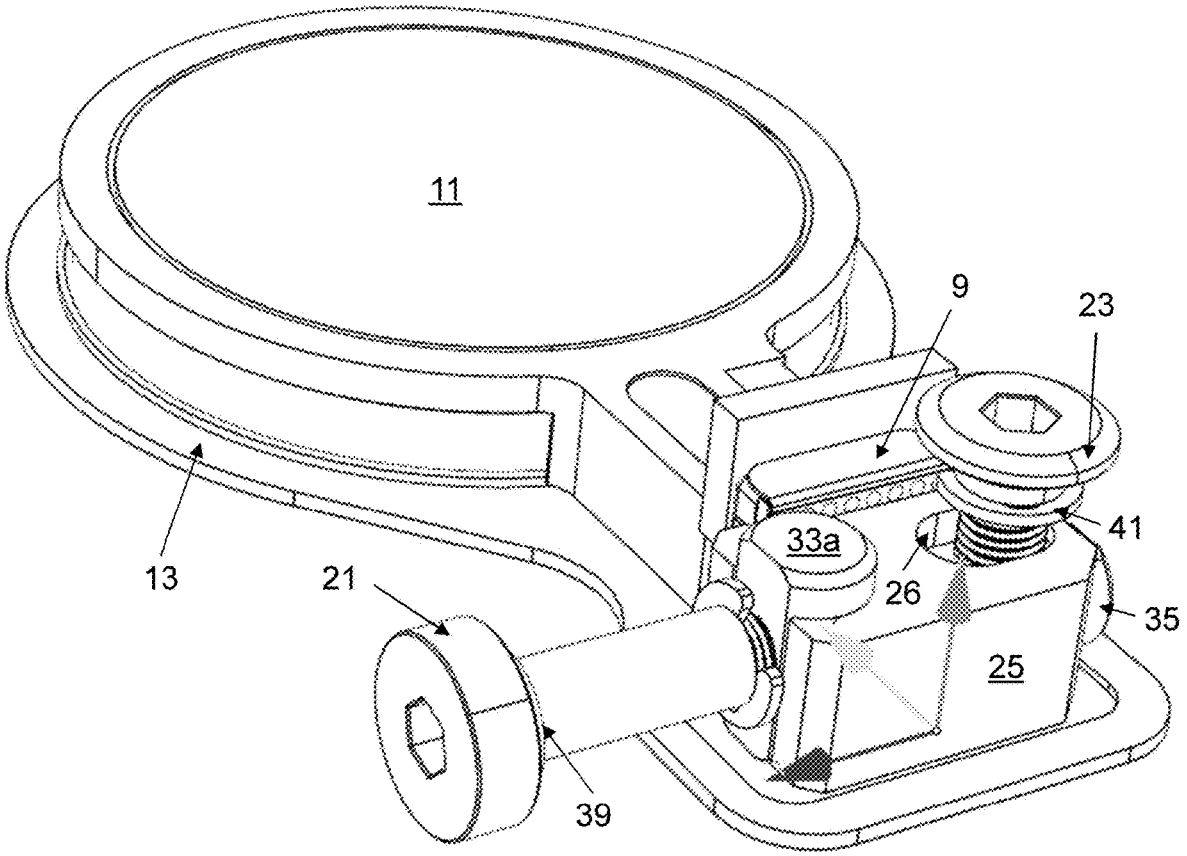
FIG. 4*b* is a view of part of the underside of the sight, with the housing removed and showing the adjustment assembly on the base.
Figure 5:
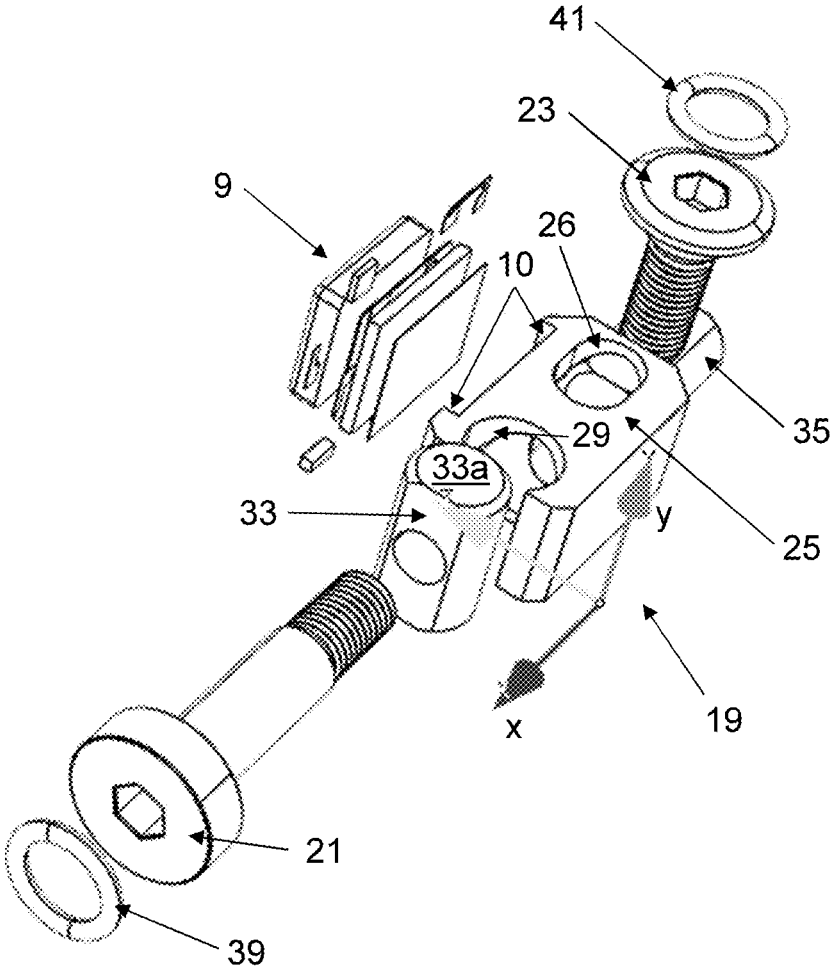
FIG. 5 is an exploded view of the adjustment assembly in the first embodiment.
Figure 6:
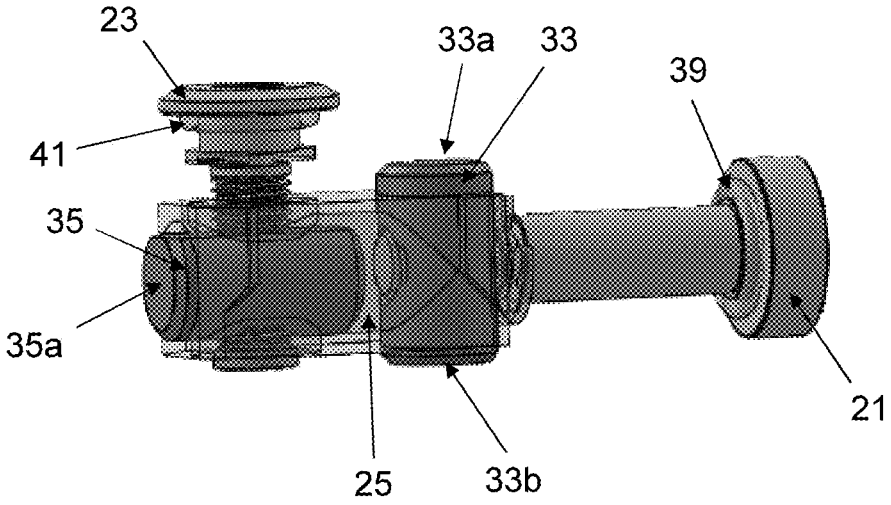
FIG. 6 is a perspective view of the adjustment assembly of the first embodiment, with the carrier shown in phantom.
Figure 7:
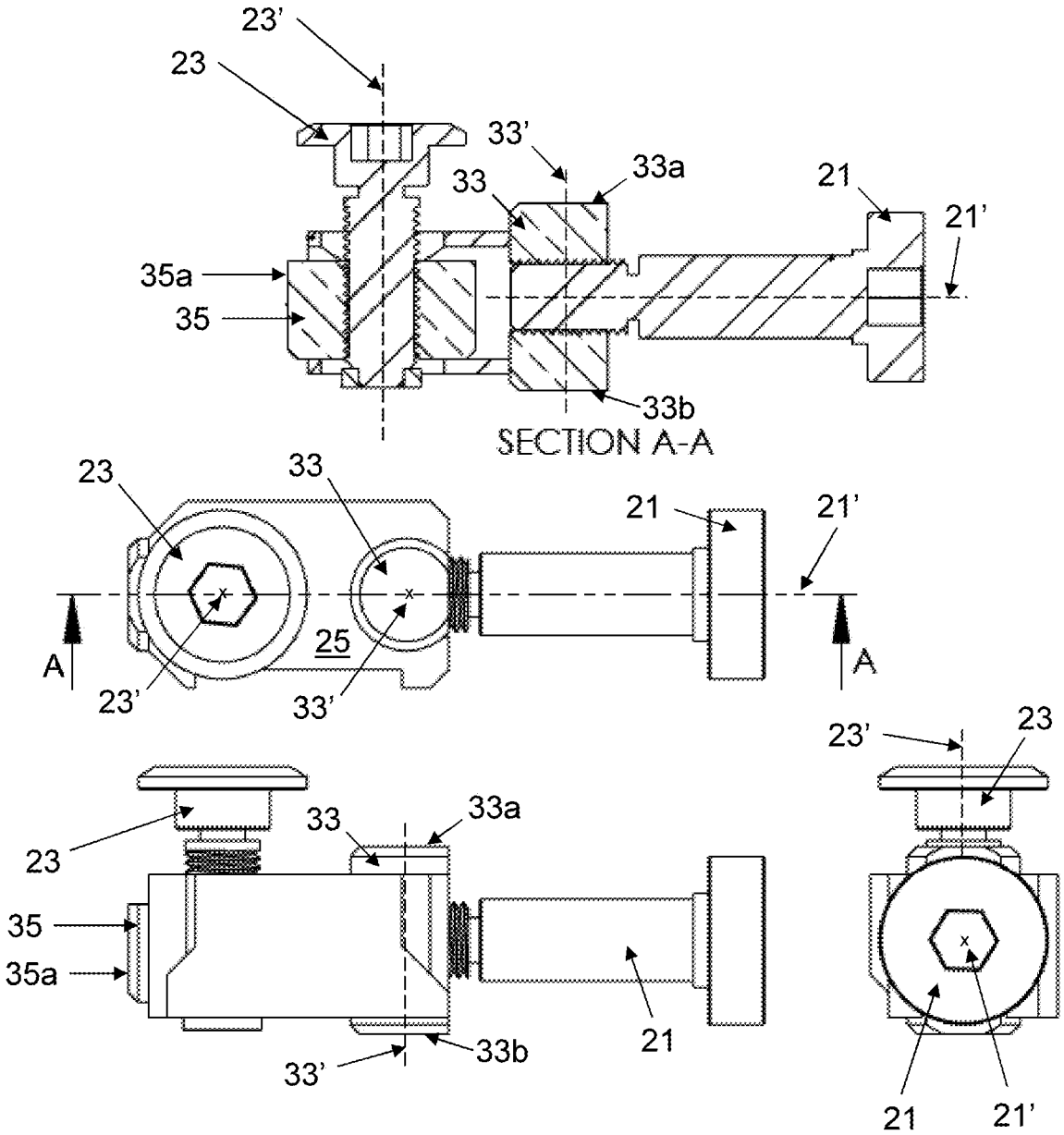
FIG. 7 shows three orthographic projections and a sectional view through the adjustment assembly in the first embodiment.

The barrel nuts 33, 35 and the carrier body 25 are located within a cavity 37 in the housing, which is most clearly visible in FIGS. 4*a* and 4*b*. The cavity 37 is formed in the underside of the housing 3 and is sealed at its base by the base element 13. The first (i.e. vertical) barrel nut 33 has a flat top 33*a* and bottom 33*b*. In this embodiment, the flat faces 33*a*, 33*b* on the top and bottom of the barrel nut, are not in contact with the top/bottom of the cavity. Nevertheless, the barrel nut 33 is prevented from moving vertically within the cavity by the fact that the corresponding horizontal adjustment screw 21 is vertically located (i.e. fixed in the vertical direction) in the housing and that the threaded engagement between barrel nut 33 and screw 21 has a small tolerance. The barrel nut 33 can, of course, move horizontally along the horizontal adjustment screw 21 and move horizontally within the cavity 37.

The second (i.e. horizontal) barrel nut 35 has a flat end 35*a*. The vertical screw 23, essentially fixes the barrel nut 35 in the horizontal (X) direction by the fact that this adjustment screw 23 is horizontally located (i.e. fixed in the horizontal direction) in the housing and that the threaded engagement between barrel nut 35 and screw 23 has a small tolerance. The barrel nut 35 can, of course, move vertically along the vertical adjustment screw 23 and move vertically within the cavity 37.

By virtue of the complementary shapes of the channels 29, 31 and barrel nuts 33, 35, relative movement between the carrier body 25 and the first barrel nut 33 is only permitted in the vertical direction. Likewise, relative movement between the carrier body 25 and the second barrel nut 35 is only permitted in the horizontal direction.

Moreover, the first channel 29 is parallel to the longitudinal axis of the vertical adjustment screw 23, and the second channel 31 is parallel to, and coaxial with, the longitudinal axis of the horizontal adjustment screw 21.

Thus, when the horizontal adjustment screw 21 is rotated into its barrel nut 33, it draws/pulls the barrel nut 33 along the screw thread, and in turn moves the carrier body 25 horizontally (i.e. there is relative movement between the carrier body 25 and the other (second) barrel nut 35 as the bore 31 moves over that barrel nut 35). Likewise, when the vertical adjustment screw 23 is rotated into its barrel nut 35, it draws/pulls the barrel nut 35 along the screw thread, and in turn moves the carrier body 25 vertically (i.e. there is relative vertical movement between the carrier body 25 and the other (first) barrel nut 33 as the vertical channel 29 moves over that barrel nut.

The above-described arrangement has been found to be especially beneficial because the adjustment screws 21, 23 need only undergo rotational movement (and no axial movement) to move the carrier body 25. The adjustment assembly therefore requires only circumferential seals in the form of O-rings 39, 41 in order to seal the LED module from foreign bodies, moisture etc. Furthermore, the adjustment assembly is relatively compact because the axes 21', 23', of the adjustment screws 21, 23 need not be offset—in fact they can intersect (see FIG. 7). This enables the adjustment unit to be mounted relatively low on the firearm, which is beneficial, for example for achieving co-witness with the iron sights 17.

Figure 10:
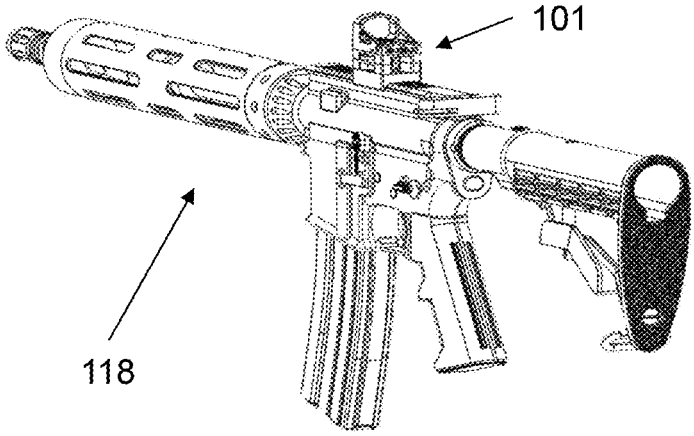
FIG. 10 shows a reflector sight of a second embodiment installed on a rifle.
Figure 11:
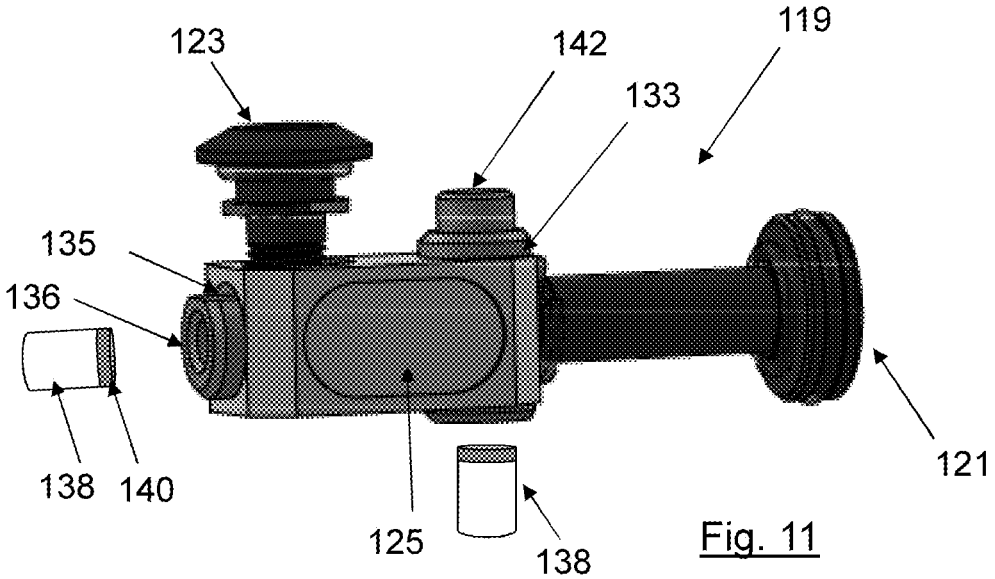
FIG. 11 is a perspective view of the adjustment assembly of the third embodiment.
Figure 12A:
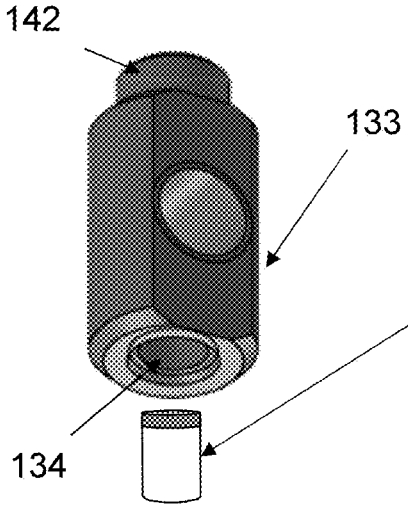
FIGS. 12*a* and 12*b* shows the vertical and horizontal barrels nuts and the grub screws of FIG. 11 in isolation.
Figure 12B:
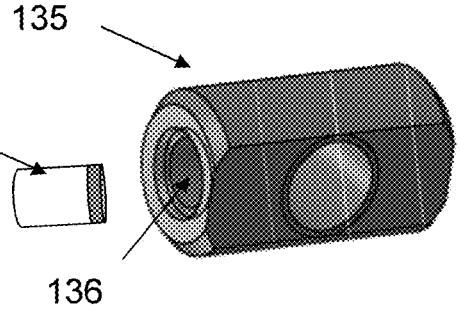
Figure 13:
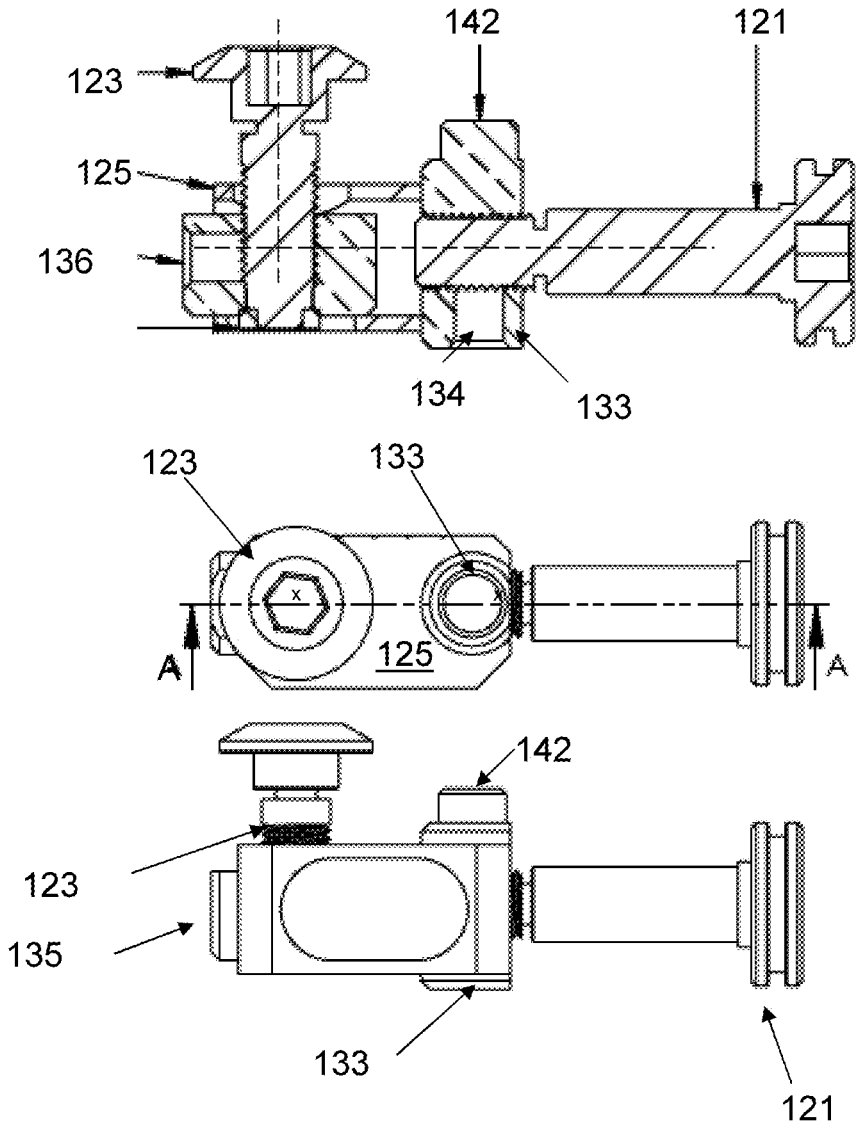
FIG. 13 shows two orthographic projections and a sectional view through the adjustment assembly in the third embodiment.
Figure 14A:
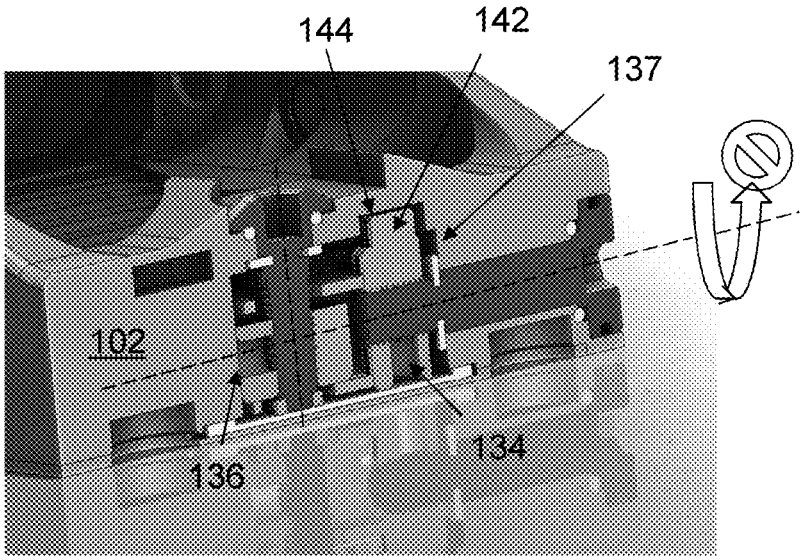
FIGS. 14*a* and 14*b* shows sectional and phantom views of the assembly of the third embodiment, installed in a cavity in the sight.
Figure 14B:
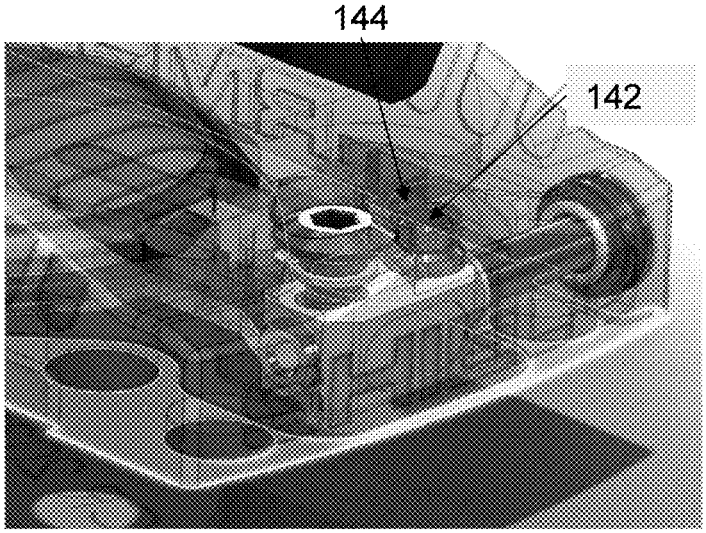

FIG. 10 illustrates a second embodiment of the invention, in which the reflector sight 101 is mounted on a rifle 118 instead of a pistol 18. In this example, the structure of the reflector sight 101 is substantially the same as that described with reference to the first embodiment.

FIGS. 11 to 14*b* show an adjustment assembly according to a third embodiment of the invention. The assembly is substantially the same as the first embodiment except for the differences described below. Like features tends to be referred to with the same reference numerals but incremented by 100:

The adjustment assembly 119 comprises a horizontal adjustment screw 121 for adjusting the location of a reticule in the field of view in a horizontal direction and a vertical adjustment screw 123 for adjusting the location of the reticule in a vertical direction. The adjustment assembly 119 comprises a carrier body 125 onto which the LED module (not visible) is mounted. The carrier body 125 has a first channel running vertically through the height of the carrier body 125 and a second channel formed as a bore running horizontally into the carrier body 125 from one end.

The first (i.e. vertical) channel contains a barrel nut 133 that is a complementary shape with the channel such that it allows the carrier body 125 to move along (i.e. up and down) the vertical barrel nut 133. The second (i.e. horizontal) channel also contains a barrel nut 135 that is a complementary shape with the channel such that it allows the carrier body to move along (i.e. laterally) the horizontal barrel nut 135.

In contrast to the barrel nuts in the first embodiment, the barrel nuts 133 and 135 in the third embodiment each have a screw threaded secondary bore 134, 136 extending through one side of the barrel nut and intersecting, in a perpendicular direction, the bore of the barrel nut (into which the corresponding adjustment screw is received). A biasing member in the form of a grub screw 138 (shown schematically exploded from the secondary bores in FIGS. 11 to 12*b*) is received in each of the secondary bore 134, 136. The bores 134, 136 have an internal screw thread but these are not shown in these figures.

The grub screw 138 has a steel head and shank with a nylon end cap 140 (shown in a darker color but only labelled in some images of the grub screw 138).

In the third embodiment, the thread of the barrel nuts 133, 135 and the adjustment screws 123, 121 has a slightly lower tolerance than that in the first embodiment. When the adjustment screws 121, 123 are threaded into the corresponding barrel nuts 133, 135 the grub screws 138 are then inserted into the secondary bores 134, 136 and driven onto the side of the adjustment screws to each bias the adjustment screw thread and the corresponding barrel nut screw threads together. This minimizes any play that might have been present due to the tolerance.

By providing a grub screw 138 with a nylon end cap 140, the part of the grub screw 138 that contacts the adjustment screw is relatively soft yet exhibits some resilience. This helps reduce any remaining play that could occur between the adjustment screw and the barrel nut, but avoids damaging the thread of the adjustment screw. The head to which torque may be applied is hard and tends to be able to withstand the torque without burring.

The other difference between the third embodiment and the first embodiment is the presence of the locating peg 142 on the top of the vertical barrel nut 133. When the adjustment assembly is located in a cavity 137 in the housing 102 of the sight (see FIGS. 14*a* and 14*b*), the locating peg is received in a corresponding locating recess 144 in the housing. The locating peg 142 is received in the corresponding locating recess 144 such that movement in only the horizontal direction along the cavity 137 is possible but so that twisting of the whole adjustment assembly about a horizontal axis (for example co-axial with the horizontal adjustment screw 121) is resisted (by the peg being constrained against the sides of the recess). This twisting prevention is shown schematically with the twisted arrow and stop sign in FIG. 14*a*.

Whilst the present invention has been described and illustrated with reference to particular embodiments, it will be appreciated by those of ordinary skill in the art that the invention lends itself to many different variations not specifically illustrated herein.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

What is claimed is:

1. A reflector sight for a firearm, the reflector sight being configured to display a reticule within a field of view, comprising:

an adjustment assembly for adjusting a location of the reticule within the field of view, the adjustment assembly comprising:

a first adjustment screw for adjusting the location of the reticule in a horizontal direction;

a second adjustment screw for adjusting the location of the reticule in a vertical direction; and a carrier body associated with a reticule generator configured such that movement of the carrier body results in corresponding movement of the reticule in the field of view, wherein:

the carrier body comprises a first channel receiving a first barrel nut, and a second channel receiving a second barrel nut, the first barrel nut is in screw-threaded engagement with the first adjustment screw, the second barrel nut is in screw-threaded engagement with the second adjustment screw, the first channel is orientated vertically to allow relative movement between the carrier body and the first barrel nut along the first channel in the vertical direction and to prevent relative movement in the horizontal direction, the second channel is orientated horizontally to allow relative movement between the carrier body and the second barrel nut along the second channel in the horizontal direction and to prevent relative movement in the vertical direction, rotation of the first adjustment screw can move the carrier body in the horizontal direction without horizontal movement of the first adjustment screw, and rotation of the second adjustment screw can move the carrier body in the vertical direction without vertical movement of the second adjustment screw.

2. The reflector sight according to claim 1, wherein:

the first and second adjustment screws each comprise a respective longitudinal axis along their length, the first channel is parallel to a longitudinal axis of the second adjustment screw, and the second channel is parallel to a longitudinal axis of the first adjustment screw.

3. The reflector sight according to claim 2, wherein the longitudinal axis of the first adjustment screw is coaxial with the second channel.

4. The reflector sight according to claim 2, wherein the first and second adjustment screws are positioned such that the longitudinal axes of the first and second adjustment screws intersect.

5. The reflector sight according to claim 1, wherein the reticule generator comprises an LED unit for creating a dot reticule.

6. The reflector sight according to claim 5, wherein the reticule generator is mounted on the carrier body.

7. The reflector sight according to claim 1, wherein:

the first and second barrel nuts are each substantially cylindrical in shape, and the first and second barrel nuts each comprise a screw threaded hole having an axis extending normal to a longitudinal axis of the cylindrical shape of the respective first or second barrel nut.

8. The reflector sight according to claim 7, wherein the first channel in the carrier body comprises a vertical through-bore configured to enable vertical movement of the carrier body relative to the first barrel nut.

9. The reflector sight according to claim 7, wherein the second channel in the carrier body comprises a horizontal bore configured to enable horizontal movement of the carrier body relative to the second barrel nut.

10. The reflector sight according to claim 1, wherein:

the reflector sight comprises a housing within which the adjustment assembly is mounted, heads of the first and second adjustment screws are accessible from an exterior of the housing.

11. The reflector sight according to claim 10, wherein the reflector sight comprises a circumferential seal located between the housing and each of the first and second adjustment screws.

12. The reflector sight according to claim 1, wherein the adjustment assembly further comprises:

a first biasing member arranged to bias a first screw thread of the first adjustment screw onto a first screw thread of the first barrel nut; and a second biasing member arranged to bias a second screw thread of the second adjustment screw on a second screw thread of the second barrel nut.

13. The reflector sight according to claim 12, wherein:

the first and second biasing members comprise first and second respective grub screw arranged to exert biasing forces in a direction perpendicular to a longitudinal axis of the first and second respective adjustment screws, and the first and second biasing members are located in first and second respective bores in first and second respective barrels, and the first and second respective bores intersect a screw-threaded bore in the first and second respective barrel nuts into which the first and second respective adjustment screws are located.

14. The reflector sight according to claim 13, wherein a tip of each of the first and second grub screw is nylon.

15. A firearm, comprising:

a reflector sight for a firearm, the reflector sight being configured to display a reticule within a field of view, comprising:

an adjustment assembly for adjusting a location of the reticule within the field of view, the adjustment assembly comprising:

a first adjustment screw for adjusting the location of the reticule in a horizontal direction;

a second adjustment screw for adjusting the location of the reticule in a vertical direction; and a carrier body associated with a reticule generator configured such that movement of the carrier body results in corresponding movement of the reticule in the field of view, wherein:

the carrier body comprises a first channel receiving a first barrel nut, and a second channel receiving a second barrel nut, the first barrel nut is in screw-threaded engagement with the first adjustment screw, the second barrel nut is in screw-threaded engagement with the second adjustment screw, the first channel is orientated vertically to allow relative movement between the carrier body and the first barrel nut along the first channel in the vertical direction and to prevent relative movement in the horizontal direction, the second channel is orientated horizontally to allow relative movement between the carrier body and the second barrel nut along the second channel in the horizontal direction and to prevent relative movement in the vertical direction, rotation of the first adjustment screw can move the carrier body in the horizontal direction without horizontal movement of the first adjustment screw, and rotation of the second adjustment screw can move the carrier body in the vertical direction without vertical movement of the second adjustment screw.

16. A method, comprising:

adjusting a location of a reticule within a field of view on a firearm reflector sight with an adjustment assembly, the adjustment assembly comprising:

a first adjustment screw for adjusting the location of the reticule in a horizontal direction;

a second adjustment screw for adjusting the location of the reticule in a vertical direction; and a carrier body associated with a reticule generator configured such that movement of the carrier body results in corresponding movement of the reticule in the field of view, wherein:

the carrier body comprises a first channel receiving a first barrel nut, and a second channel receiving a second barrel nut, the first barrel nut is in screw-threaded engagement with the first adjustment screw, the second barrel nut is in screw-threaded engagement with the second adjustment screw, the first channel is orientated vertically to allow relative movement between the carrier body and the first barrel nut along the first channel in the vertical direction and to prevent relative movement in the horizontal direction, the second channel is orientated horizontally to allow relative movement between the carrier body and the second barrel nut along the second channel in the horizontal direction and to prevent relative movement in the vertical direction, rotation of the first adjustment screw can move the carrier body in the horizontal direction without horizontal movement of the first adjustment screw, and rotation of the second adjustment screw can move the carrier body in the vertical direction without vertical movement of the second adjustment screw.

17. A reflector sight for a firearm, the reflector sight being configured to display a reticule within a field of view, comprising:

an adjustment assembly configured to adjust a location of the reticule within the field of view, the adjustment assembly comprising:

a pair of mutually perpendicular adjustment screws, each having a screw threaded shaft and a respective longitudinal axis, the pair of adjustment screws being configured to adjust the location of the reticule in respective perpendicular directions, wherein the longitudinal axis of one of the pair of adjustment screws intersects the screw threaded shaft of an other one of the pair of adjustment screws; and a carrier body associated with a reticule generator and comprising:

a pair of mutually perpendicular substantially cylindrical channels within which respective substantially cylindrical barrel nuts for the pair of adjustment screws are located, wherein each respective channel of the pair of channels is configured to allow longitudinal movement of its respective barrel nut along the respective channel and to constrain movement perpendicular thereto, and wherein the pair of adjustment screws is configured such that rotation of a respective adjustment screw of the pair of adjustment screws causes the carrier body to move in a direction perpendicular to the respective adjustment screw without causing any axial movement of the respective adjustment screw.

* * * * *